US005907890A

United States Patent [19]

Redaelli

[11] Patent Number: 5,907,890

[45] Date of Patent: Jun. 1, 1999

[54] GUIDING DEVICE FOR SLIDING DOORS

[75] Inventor: Gianfranco Redaelli, Giussano, Italy

[73] Assignee: Molteni & C. S.p.A., Milan, Italy

[21] Appl. No.: 08/741,682

[22] Filed: Oct. 31, 1996

[30] Foreign Application Priority Data

Apr. 23, 1996 [IT] Italy ..... MI960313 U

[51] Int. Cl.[6] ..... A47H 1/04; E05D 15/06

[52] U.S. Cl. ..... 16/96 R; 16/94 R; 16/93 R

[58] Field of Search ..... 16/88, 91, 93 R, 16/96 R, 94 R, 95 R, 86.1, 87 R, 106, 87.6 R, 87.8, 87.2, 87.4 R, 96 D, 93 D

[56] References Cited

U.S. PATENT DOCUMENTS

| | | | |
|---|---|---|---|
| 1,067,678 | 7/1913 | Prim | 16/96 R |
| 1,251,483 | 1/1918 | Days | 16/94 R |
| 2,048,845 | 7/1936 | Danley | 16/88 |
| 2,207,322 | 7/1940 | Long | 16/88 |
| 2,728,101 | 12/1955 | Cowdroy | 16/88 |
| 3,745,706 | 7/1973 | Stermac | 16/93 R |
| 5,165,142 | 11/1992 | Pilsbury | 16/91 |

*Primary Examiner*—Chuck Mah
*Attorney, Agent, or Firm*—Wenderoth, Lind & Ponack

[57] ABSTRACT

A guiding device for sliding doors is disclosed and includes a guide bar and door supporting elements that travel along the guide bar. The guide bar and each door supporting element form a recirculating ball bearing sliding pair. The guide bar and the door supporting element have cylindrical mating surfaces The sliding pair comprises ball sleeve bearings placed inside a cylindrical tube which is integral with the respective door supporting elements.

8 Claims, 2 Drawing Sheets

GUIDING DEVICE FOR SLIDING DOORS

BACKGROUND OF THE INVENTION

The present invention generally relates to guiding devices for sliding doors and, more particularly, an improved device of this type.

DESCRIPTION OF THE PRIOR ART

Guiding devices for sliding doors or shutters are generally known in the furniture industry.

Generally, some of the usual kinds of these devices are sliding pairs with a sliding contact between mating surfaces of a door supporting element and of a guide bar. The advantage of the simple structural arrangement of these devices, and therefore of their low manufacturing costs, is to a large extent overcome by the drawback of having a sliding contact which features a large amount of friction, particularly at the beginning of motion which is reduced essentially by the periodic lubrication of the contacting surfaces. Thus, manual opening and closing of the sliding door is difficult if the contacting surfaces are not well lubricated.

Other types of known guiding devices use door supporting elements which are mounted on wheels or rollers and travel along a guide bar.

Although the latter guiding devices have a more complex structural arrangement than those previously described due to the presence of carriages and guide bars having cross sections of a particular shape that is suitable for the motion of the carriages, these devices are greatly advantageous because they replace the sliding contact with a rolling contact which is characterized by a small amount of friction, including at the start of motion. However, these devices are sometimes noisy and subject to jamming and dragging of the wheels which make their running difficult.

SUMMARY OF THE INVENTION

The object of the present invention is to obviate the aforsaid drawbacks of the prior art by providing a new guiding device which has little frictional resistance and operates smoothly and silently, while maintaining a simple structural arrangement and requiring infrequent maintenance for assuring the preservation of such a features at all times.

More particulary, the guiding device for sliding doors according to the present invention includes a guide bar and at least one door supporting element that travels along the guide bar and is characterized in that the guide bar and the door supporting element form a ball bearing sliding pair. The guide bar and the door supporting element have cylindrical mating surfaces.

According to a feature of the present invention, the ball bearing sliding pair includes ball sleeve bearings placed inside a cylindrical tube which is integral with the door supporting element.

BRIEF DESCRIPTION OF THE DRAWINGS

The features and the advantages of the present invention will be disclosed in the following description with reference to the the accompanying drawings, wherein.

DESCRIPTION OF THE PREFERRED EMBODIMENTS

Figure 1:
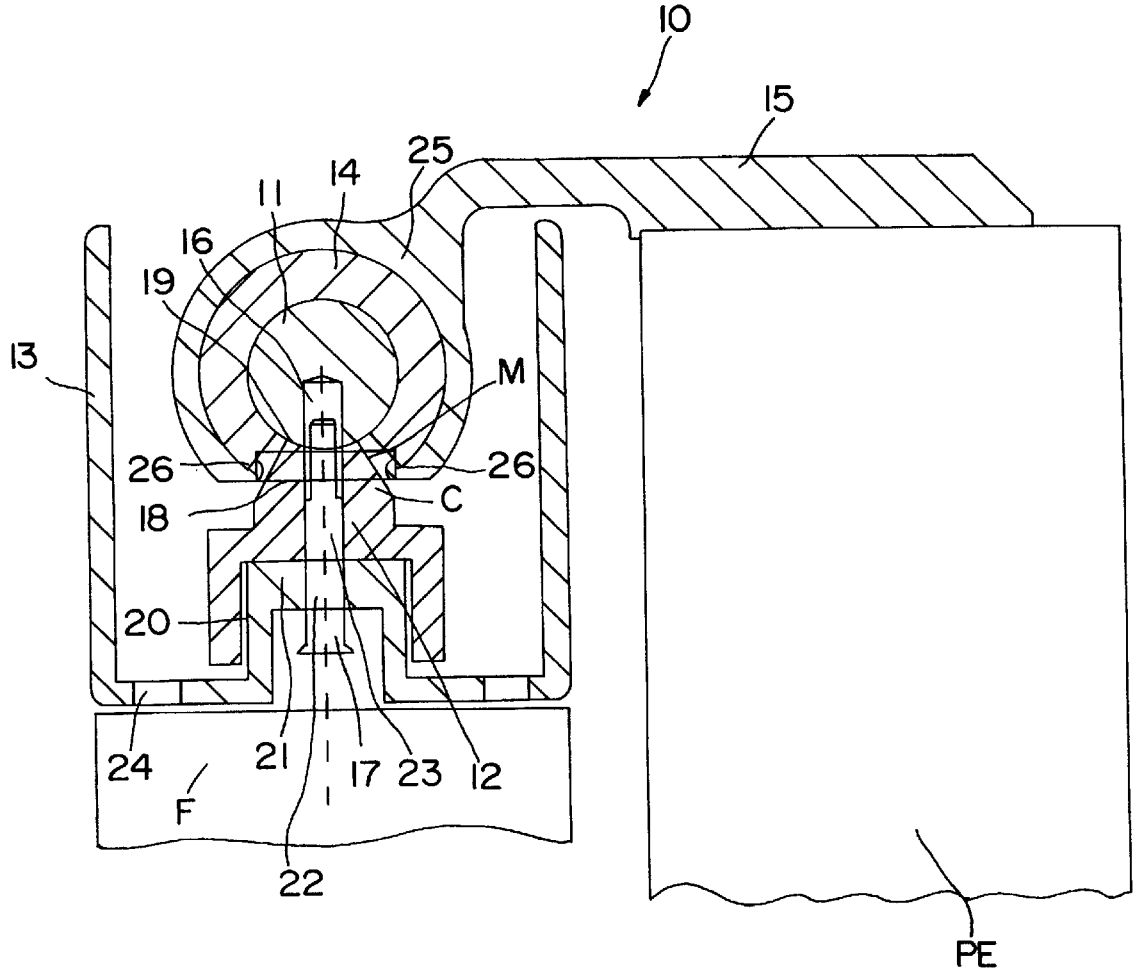
FIG. 1 is a cross sectional view of a guiding device of the present invention as applied to an externally sliding door.

Referring to FIG. 1, the guiding device according to the present invention, generally designated by 10, comprises a solid cylindrical guide bar 11, supported by a support 12 and disposed inside a receiving box 13, for example in the shape of extruded aluminium element. Open sleeve rolling bearings 14 travel along the guide bar 11 and are fitted inside an extruded aluminium cylindrical tube which has a supporting arm 15 for an externally sliding door PE.

Figure 2:
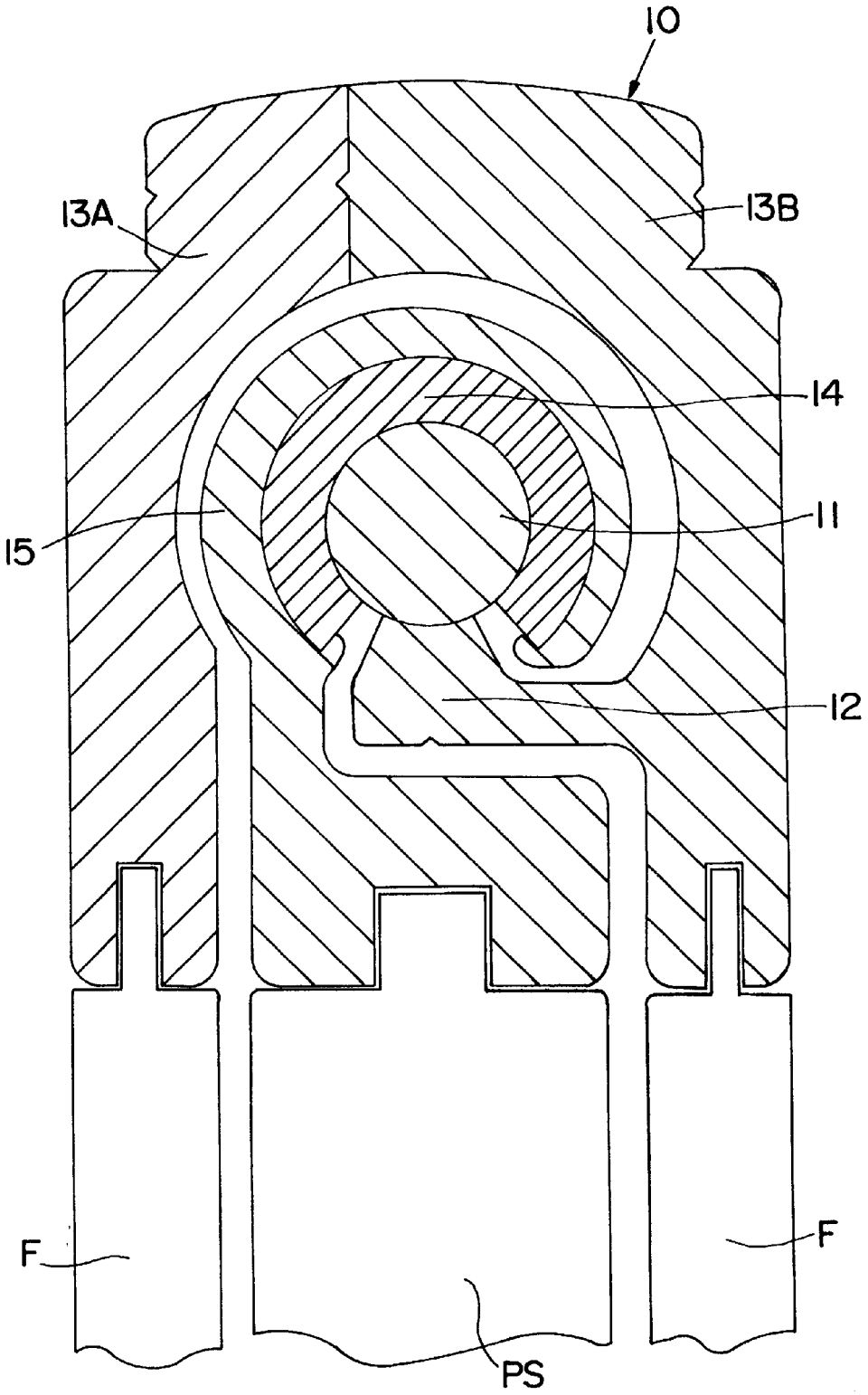
FIG. 2 is a cross sectional view of the guiding device of the present invention as applied to an internally sliding door.

According to a modification illustrated in FIG. 2, the receiving box for the guiding device 10 is formed of two portions 13A and 13B which are connected to each other and the support 12 of the cylindrical guide bar 11 is integral with the portion 13B of the receiving box 13. The open sleeve rolling bearings 14 travelling along the cylindrical guide bar 11 are located in an extruded cylindrical tube which has a supporting arm 15 for an internally sliding door PS.

As can be seen from FIG. 1, the cylindrical guide bar 11 is provided with a set of radial threaded dead end holes 16, aligned with the same generating line and equally spaced apart, in which fastening screws 17 are screwed for connecting the cylindrical guide bar 11 to the support 12 and to the receiving box 13. The cylindrical guide bar 11 is made of a wearproof material with a high case hardness. For instance, a cylindrical guide bar of hardened chromium steel is suitable for the purposes of the guiding device 10.

The support 12 supports the cylindrical guide bar 11 for its overall length in order to prevent inflection and, therefore, guidance inaccuracy and is provided with an upper tapered portion 18, which ends in a surface 19 with the mating the surface of the cylindrical guide bar 11, and a lower groove 20 into which a projecting portion 21 of the receiving box 13 is fastened. The projecting portion 21 of the receiving box 13 and the groove 20 of the support 12 are in a close fit. The support 12 is provided with a plurality of through holes 22 which, in assembling the guiding device 10, are aligned with the radial threaded dead end holes 16 of the cylindrical guide bar 11 and with through holes 23 of the projecting portion 21 of the receiving box 13 by inserting and screwing in the support 12 and in the receiving box 13 the fastening screws 17 which fasten the cylindrical guide bar 11 thereto. The receiving box 13 is provided with through holes 24 for receiving fastening screws (not shown) which fasten it to a wall or, generally, to a fixed structure F. Both the support 12 of the cylindrical guide bar 11 and the receiving box 13 are made of a light and, at the same time, resistant material, e.g. an aluminium alloy, and are shaped by extrusion.

The extruded aluminium supporting arm 15 projects from the receiving box 13 of the guiding device 10 in order to support an externally sliding door PE in front of a fixed wall F and is integral with a cylindrical tube 25 which is intended to enclose the open sleeve rolling bearings 14. The supporting arm 15 and the cylindrical tube 25 are made of a light and resistant material, e.g., an aluminium alloy and are integrally shaped by extrusion. The cylindrical tube 25 is provided with a longitudinal opening C adapted to receive the upper tapered portion 18 of the support 12 of the cylindrical guide bar 11 during the operation of the guiding device 10. The cylindrical tube also has a pair of lips 26 by means of which the cylindrical tube 25 and the open sleeve rolling bearings 14 are connected to each other in such a manner as to place the longitudinal opening C of the former over an open portion M of the latter. In addition, the lips 26 prevent the rotation of the open sleeve rolling bearings 14 with respect to the cylindrical tube 25 while the close fit of the portions is sufficient to prevent relative axial movement.

The open sleeve rolling bearing 14 is of a type employing recirculation balls. More particularly, sleeve bearings of this type, already known in this art, have been shown to be suitable for the purposes of the present invention since they are characterized by very little friction, also at the starting of motion, which is also independent of velocity. Sleeve bearings of this type are provided with a fastening system that prevents their rotation about the longitudinal axis by means of a security dowel.

Referring to FIG. 2, there is shown a modification of the guiding device of the present invention according to which the receiving box is formed of two portions 13A and 13B connected to each other, the latter portion being integral with the support 12 of the cylindrical guide bar 11. The supporting arm 15 is not cantilevered, but arranged in a central position and supports an internally sliding door PS sliding between two fixed walls F to which the receiving box of the guiding device is attached.

With regard to the device previously described and illustrated in FIGS. 1 and 2, the assembly formed of the supporting arm 15 with the open sleeve rolling bearing 14 placed inside the cylindrical tube 25 and the cylindrical guide bar 11 represents substantially a sliding pair in which sliding contact has been replaced with a rolling contact by using recirculating balls. This makes it possibile to provide a sliding pair with a very small coefficient of friction, also at the starting of motion, and without changes of the frictional resistance when changing from the condition of zero relative velocity to that of nonzero relative velocity.

Other advantageous features of the guiding device according to the present invention are:

manual opening and closing of the sliding door without jamming, silent running, and movement of the sliding door without oscillations in its movement.

In order to prevent oscillations of the sliding door, the latter can be provided also with a lower slideway.

What is claimed is:

1. A device for guiding and supporting a sliding door on a fixed structure, said device comprising:

an elongated substantially U-shaped housing securable to the fixed structure;

a guide bar support disposed within said U-shaped housing;

an elongated cylindrical guide bar disposed in said U-shaped housing and connected to said guide bar support so as to be supported thereby along its length;

a door supporting element including a cylindrical tube and a sliding door fastening arm projecting outwardly and laterally of said U-shaped housing, said cylindrical tube having a longitudinal opening which straddles said guide bar support, wherein said cylindrical tube is located in said U-shaped housing and said elongated cylindrical guide bar is received in said cylindrical tube; and a plurality of recirculating ball bearings retained in said cylindrical tube in rolling relationship with an outer peripheral surface of said elongated cylindrical guide bar.

2. The device as claimed in claim 1, wherein said U-shaped housing has an upwardly extending projection which is received in a channel formed in a lower portion of said guide bar support.

3. The device as claimed in claim 1, further comprising a pair of inwardly directed lips formed on edges of said cylindrical tube defining said longitudinal opening, respectively, for retaining said plurality of recirculating ball bearings in said cylindrical tubes.

4. A device for guiding and supporting a sliding door on a fixed structure, said device comprising:

an elongated substantially U-shaped housing securable to the fixed structure;

a guide bar support secured to an interior bottom portion of said U-shaped housing;

an elongated cylindrical guide bar disposed in said U-shaped housing and connected to said guide bar support so as to be supported thereby along its entire length;

a door supporting element including a cylindrical tube and a sliding door fastening arm projecting outwardly and laterally of said U-shaped housing, said cylindrical tube having a longitudinal opening which straddles said guide bar support, wherein said cylindrical tube is located in said U-shaped housing and said elongated cylindrical guide bar is received in said cylindrical tube; and an open sleeve rolling bearing including a plurality of recirculating ball bearings, said open sleeve rolling bearing being retained in said cylindrical tube in rolling contact relationship with an outer peripheral surface of said elongated cylindrical guide bar.

5. The device as claimed in claim 4, wherein said U-shaped housing has an upwardly extending projection which is received in a channel formed in a lower portion of said guide bar support.

6. The device as claimed in claim 4, further comprising a pair of inwardly directed lips formed on edges defining said longitudinal opening formed in said cylindrical tube, respectively, for retaining said open sleeve rolling bearing in said cylindrical tube.

7. A guiding device for a sliding door arranged to slide between a pair of fixed structures and to close an opening formed therebetween, said guiding device comprising:

an elongated substantially U-shaped housing formed of a first portion and a second portion, each of said first and second portions being secured to the pair of fixed structures, respectively;

a guide bar support securable to said first portion;

a cylindrical guide bar fixedly supported on said guide bar support;

a door supporting element adapted to travel along said cylindrical guide bar, said door supporting element having a downwardly projecting fastening arm connectable to the sliding door and a cylindrical tube having a longitudinal opening straddling said guide bar support such that said guide bar is received in said cylindrical tube;

a plurality of recirculating ball bearings disposed between an inner peripheral surface of said cylindrical tube and an outer peripheral surface of said cylindrical guide bar such that said cylindrical guide bar is movable relative to said cylindrical guide bar, wherein said guide bar, said guide bar support, and said sliding door supporting element are enclosed within said U-shaped housing.

8. The device as claimed in claim 7, wherein said plurality of recirculating ball bearings are received in an open sleeve bearing which is retained in said cylindrical tube.

* * * * *